US008096726B2

(12) United States Patent
Cananzey

(10) Patent No.: US 8,096,726 B2
(45) Date of Patent: Jan. 17, 2012

(54) SHEET LIFTER

(76) Inventor: Gary M. Cananzey, Wareham, MA (US)

( * ) Notice: Subject to any disclaimer, the term of this patent is extended or adjusted under 35 U.S.C. 154(b) by 895 days.

(21) Appl. No.: 11/544,098

(22) Filed: Oct. 6, 2006

(65) Prior Publication Data

US 2008/0085147 A1 Apr. 10, 2008

(51) Int. Cl.

| | |
|---|---|
| ***B42F 13/00*** | (2006.01) |
| ***B42F 13/20*** | (2006.01) |
| ***B42F 3/00*** | (2006.01) |
| ***B42F 13/12*** | (2006.01) |

(52) U.S. Cl. ..... 402/80 L; 402/24; 402/37; 402/71; 402/79; 402/80 R; 402/80 P

(58) Field of Classification Search ..... 235/469, 235/470, 494; 283/58, 74, 85, 93, 902; 428/916; 402/24, 37, 71, 79, 80 R, 80 L, 80 P; *B41M 03/14; G03C 05/08; G03G 21/04; G06K 01/00, G06K 01/12, 19/06; G06T 01/00; H04N 01/32*
See application file for complete search history.

(56) References Cited

U.S. PATENT DOCUMENTS

| | | | | |
|---|---|---|---|---|
| 1,107,351 | A * | 8/1914 | Proudfit | 402/79 |
| 1,959,858 | A * | 5/1934 | Dawson | 402/37 |
| 2003/0223804 | A1 * | 12/2003 | Roca | 402/79 |

* cited by examiner

*Primary Examiner* — Dana Ross
*Assistant Examiner* — Justin Lewis
(74) *Attorney, Agent, or Firm* — James F. Baird

(57) ABSTRACT

Sheet Lifter for use with multi ring sheet or page holders and multi ring binders. The Device is made from a thin ridged panel with a plurality of notches and slots. The Device is positioned in order to interact with the rings and binder spine of the page holder or binder. The Device rests on the spine with the pages or sheets resting on the Device. The Device prevents the pages or sheets from traveling past the maximum horizontal diameter point of the rings when the holder or binder is fully opened. When the holder or binder is closed the Device creates sufficient upward pressure against the pages or sheets to return them to their closed position at the maximum vertical diameter point of the rings. The pressure required is minimal.

6 Claims, 7 Drawing Sheets

SHEET LIFTER

BACKGROUND

The field of my invention is Sheet Lifters as used with multi ring sheet or page holders and multi ring binders. In the past various devices have been used to solve the page jamming or impingement problem that occurs when the holder or binder is closed after being opened. This is an invention that solves the page jamming/impingement problem caused when loose-leaf binders are closed. As most people know, the sheets or pages tend to slide around the rings to lay flat on the front and back covers of the holder or binder when the holder or binder is in the open or use position. When the holder or binder is closed (moving the covers to the closed position) the sheets or pages resist movement around the rings due to friction and are held captive between the ring(s) and cover(s) requiring an additional step by the user to slide the sheets or pages up the rings to a point above the horizontal, then the holder or binder may be closed with the sheets or pages assuming their stored or closed position. Often the step of sliding the sheets or pages up the rings to the point above the horizontal is ignored, forgotten or not thought of with the resulting friction causing damage to the sheets or pages. This problem has been inherent in ring mechanisms that are commonly used in loose-leaf binders since their inception.

We have all experienced the page jamming that occurs when closing a loose-leafbinder. With the pages laid out on the front and back covers, unless the user manually moves the pages up and toward the top center of the ring, it is virtually impossible to close such a binder without the pages/sheets being caught or jammed under the right and left sides of the ring mechanism by the cover(s). This jamming also causes pages to tear and fall out of binders.

For years companies have made sheet lifter devices of various kinds and shapes to solve this problem without success. The size of the loose-leaf market and the resultant size of the problem is evidence that there is no current solution to this problem.

An object of the invention is to provide a Sheet Lifter that is able to allow the sheets or pages to move freely from the use position when the binder is open to the stored position when the binder is closed.

A further object of the invention is to provide a Sheet Lifter that permits free movement of the sheets or pages and eliminates damage to the sheets or pages when the binder is opened and closed.

An additional object of the invention is to provide a Sheet Lifter that is inexpensive to manufacture and easy to use.

A yet further object of the invention is to provide a Sheet Lifter that may be used in conjunction with some of the currently existing Sheet Lifters type devices that are on the market without modification.

A still further object of the invention is to provide a Sheet Lifter that may be added to existing holders and binders that are already loaded with sheets or pages without modification or the need to un-load the sheets or pages from the holder or binder.

SUMMARY OF THE INVENTION

The invention portrayed is an improved Sheet Lifter for use with multi ring sheet or page holders and multi ring binders.

When the traditional multi ring sheet or page holder and multi ring binder is not being used the holder or binder is in a closed configuration. When the holder or binder is being used, the holder or binder is usually in an open configuration. When the holder or binder is in the open position, the sheets or pages are able to be viewed and moved. In the open position the sheets or pages rest on either the inside of the front cover, back cover or both. When the holder or binder is changed from the closed position to the open position the sheets or pages slide around the rings from the highest diameter extreme of the rings (closed position) past the horizontal diameter extreme of the rings almost to the bottom diameter extreme of the rings (open position). When the holder or binder is returned to the closed configuration the intent is for the sheets or pages to be returned to the highest diameter extreme of the rings. The problem is when the holder or binder is returned to the closed configuration the front and back covers cause an inward pressure on the sheets or pages when in reality the sheets or pages require an outward and upward pressure to further move upward and around the horizontal diameter extreme of the rings allowing the natural motion of the closing cover to move the pages to the highest diameter extreme of the rings.

The positioning of the sheets/pages is dependent on the motion of the closing cover. The motion of a closing cover is inward and upward in an arc. In the act of closing, a binder cover creates inward pressure on the pages/sheets causing them to first move inward toward the center of the ring mechanism. Unfortunately, the necessary motion for proper page movement is out and up. Once positioned inward, there is no motion that can be made by the simple closing of the cover to then cause outward and upward motion to the pages/sheets which would cause them to move outward and then upward and around the ring mechanism's circumference. This results in the pages/sheets being jammed into the lower part of the ring mechanism's diameter and then possibly wedged between the rings and the inside of the cover. This is why conventional or existing sheet lifter devices do not work.

The present invention solves this problem. The Sheet Lifter is positioned with the bottom edge of the Sheet Lifter on the holder or ring binders spine. The Sheet Lifter has a height dimension that is approximately equal to one-half of the diameter of the rings involved. The pages or sheets are resting on the top edge of the Sheet Lifter. The Sheet Lifter has a plurality of notches and slots that permit the Device to engage with a plurality of the rings. The Sheet Lifter, when properly positioned, has it's approximate length mid-point section resting against the outer surface of at least one ring and it's nearly end sections each resting against the inner surface of rings. As a result The Sheet Lifter positions pages/sheets so that they may be moved properly by the simple closing of the holder or binder front and back covers. The invention holds the sheet/pages high enough on the binder rings to keep them from falling below the approximate half way point, or horizontal extreme of the diameter of the ring. By doing so, the invention allows the cover of the loose-leaf binder in conjunction with the Sheet Lifter to apply the correct leverage and pressure to the sheet/pages to cause the sheet/pages to move, or slide, upward and toward the top, or highest extreme, and away from the side, or horizontal extreme, of the ring mechanism as the front and back covers are closed.

This device is unique and otherwise completely new to the world. It is inexpensive and easy to use. Each year hundreds of millions of binders with ring mechanisms are sold to offices and businesses for use as storage and display devices and albums for sample greeting cards, announcements, stationary and other printed materials. In addition millions of binders, holders and albums are sold every year to individuals including students. Binders and holders may be used for many uses ranging from holding pages of written text to sheets of samples or as photo albums. The possible uses are endless.

With the present concern about cost of production for items such as Sheet Lifters the present invention provides an economical unique and innovative Sheet Lifter. In addition, the invention eliminates unnecessary damage to sheets and pages caused by the jamming of sheets and pages as a binder is opened and closed. The foregoing is another reason for the improvement provided by the present invention.

Currently, there is no sheet lifter device on the Market that resolves the jamming problem because by itself, a sheet lifter attached to the rings cannot provide the necessary by-directional motion needed to work properly. The present invention is able to be used independently or in conjunction with a conventional sheet lifter.

The device can be made from any material ridged enough to provide the necessary support to the pages/sheets such as plastic, metal, paperboard, polystyrene, polyethylene polyvinylchloride, or other suitable materials.

The device attaches to the rings by means of holes or slots or notches or slits or a combination of the above. The device is made in such a way that the bottom edge of the device rests on the spine board of the loose-leaf binder. The device further interacts with the rings of the binder which provides support and location to the device. The pages/sheets rest on the top edge of the device. In the event a conventional sheet lifter is being used the conventional sheet lifter would rest on the top edge of the Sheet Lifter with the pages/sheets resting on top of the conventional sheet lifter. The height of the device is designed to position the sheets approximately at the middle of the ring mechanism's diameter.

When used with a multi-ring device or mechanisms with four or more rings the Sheet Lifter is still effective by staggering the position of Sheet Lifters at both the front and back covers or using multiple Sheet Lifters at both the front and back covers. Normally multi-ring mechanisms of the type used, for example in greeting card albums, are of a larger capacity or diameter. They hold larger and heavier sheets and as a result the jamming problems are of greater import. The Sheet Lifter may be made of a sturdier material for such applications.

The invention incorporates a plurality of options for height and width, as the Sheet Lifter may be used on conventional three ring binders or on multi ring binders regardless of ring diameter or spacing.

While the invention will be discussed in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

Turning first to FIG. 1 there is shown the present invention, Sheet Lifter 1.

DESCRIPTION OF THE PREFERRED EMBODIMENT

Figure 1:
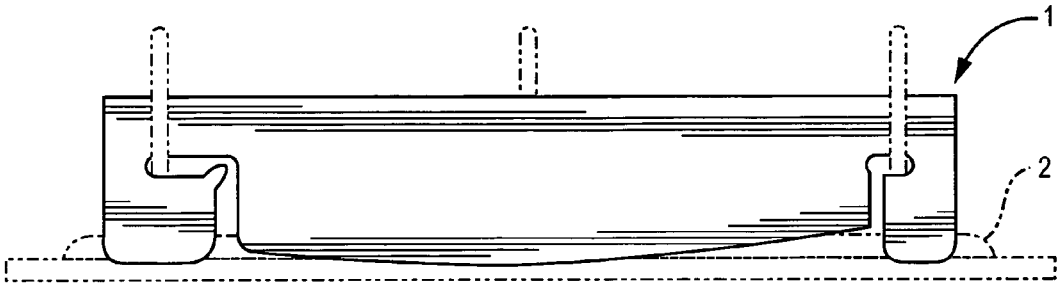
FIG. 1 is a view of the invention, showing the Sheet Lifter 1 positioned on a three ring binder. Also shown is the spine 2.
Figure 2:
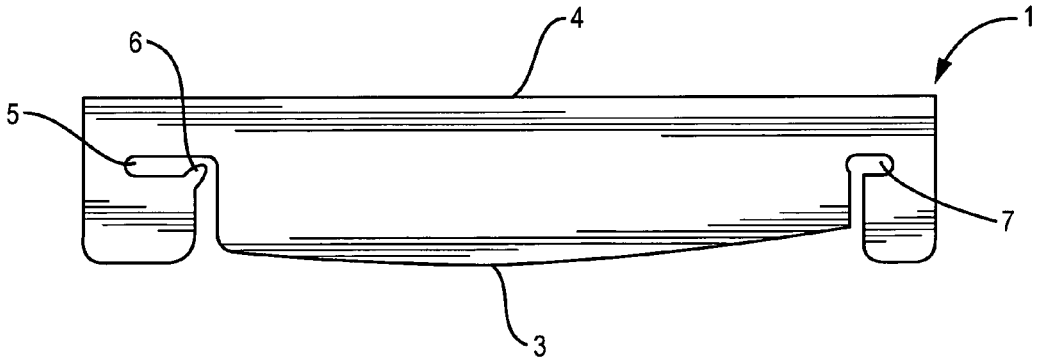
FIG. 2 is a front plan view of the Sheet Lifter 1. Shown is the bottom edge 3 (with slight curvature) and top edge 4 of the Sheet Lifter 1. In addition the elongated notch 5 (with protruding knob 6) and short notch 7 are shown.

The invention is a new and improved Sheet Lifter for use with multi ring sheet or page holders and multi ring binders as viewed in FIG. 1 where the Sheet Lifter 1, is shown positioned on a three ring binder spine 2. FIG. 2 is a front plan view of the Sheet Lifter 1. As shown the Sheet Lifter 1 is a panel that has a bottom edge 3, with a slight radius, the top edge 4 is straight. Also shown is an elongated notch 5, with a protruding knob 6, and a short notch 7.

The Sheet Lifter is a panel that is made of a material that is difficult to bend and has a position memory. The Sheet Lifter can be made from any material ridged enough to provide the necessary support to the pages/sheets involved. The material could be plastic, metal, paperboard, polystyrene, polyethylene polyvinylchloride, or other suitable materials.

The Sheet Lifter 1 as shown is a panel that is rectangular in shape having a height dimension, a length dimension and a thickness dimension. The Sheet Lifter 1 height dimension would be approximately one half the diameter of the rings of the holder or binder involved. The height dimension would be such as to be able to be used on ring holders or binders where the diameter of the rings involved varied within an acceptable range. The Sheet Lifter 1 has been tested and found to function properly even if the height dimension is slightly greater or slightly less than one half the diameter of the rings that are involved. Therefore the Sheet Lifter may be produced in models that have different height dimensions but not a never ending range of exact heights. The Sheet Lifter 1 length dimension would be greater than the distance from the first ring engaged to the last ring engaged. For the average ring holder or binder the Sheet Lifter 1 would have a thickness similar to that of paperboard. Other thicknesses would be required and determined based upon the actual material used and the weight and mass of the sheets or pages being lifted. The Sheet Lifter 1 may be used independently or together with conventional sheet lifters. When used with a conventional sheet lifter the present invention would be placed below the conventional sheet lifter in order that the bottom edge of the Sheet Lifter 1 would rest on the ring binder spine 2 and the conventional sheet lifter would, together with the sheets or pages involved, rest on the top edge of the Sheet Lifter 1.

Figure 3A:
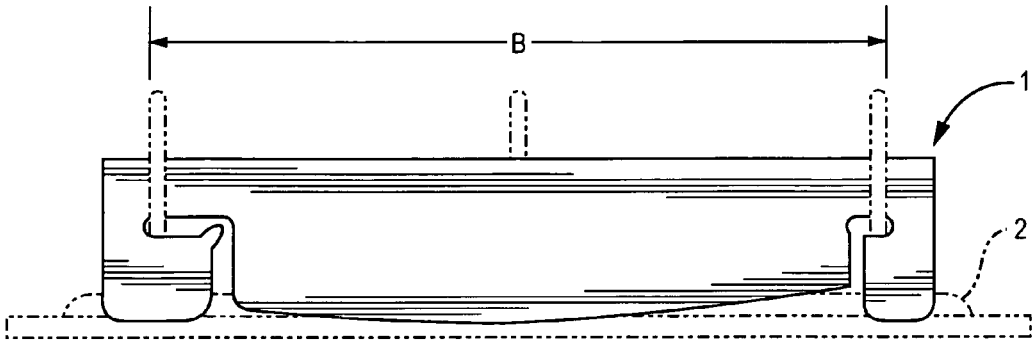
FIG. 3*a* shows a side view of the Sheet Lifter 1 positioned on a three ring binder. Also shown is the spine 2. The distance from the first ring to the third ring is indicated as B.
Figure 3B:
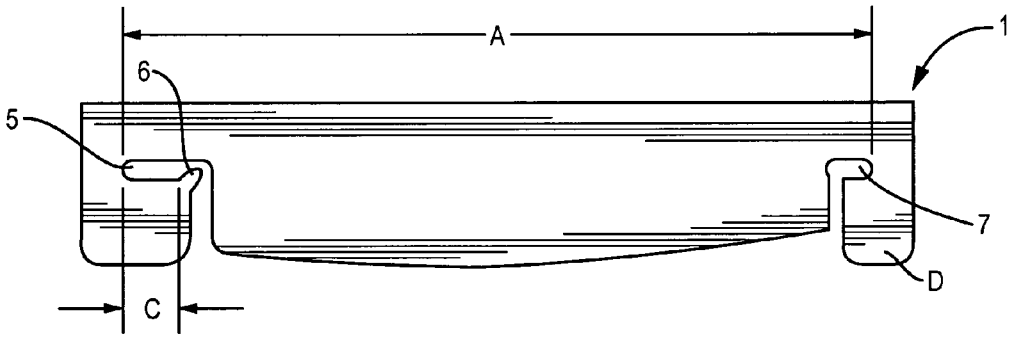
FIG. 3*b* shows the Sheet Lifter 1 with the distance from the extreme end of the elongated notch 5 to the extreme end of the short notch 7 being indicated as A. The distance from the protruding knob 6 to the extreme end of elongated notch 5 is indicated as C. Further the short notch is labeled as D. The distance A is slightly longer than the distance B.
Figure 3C:
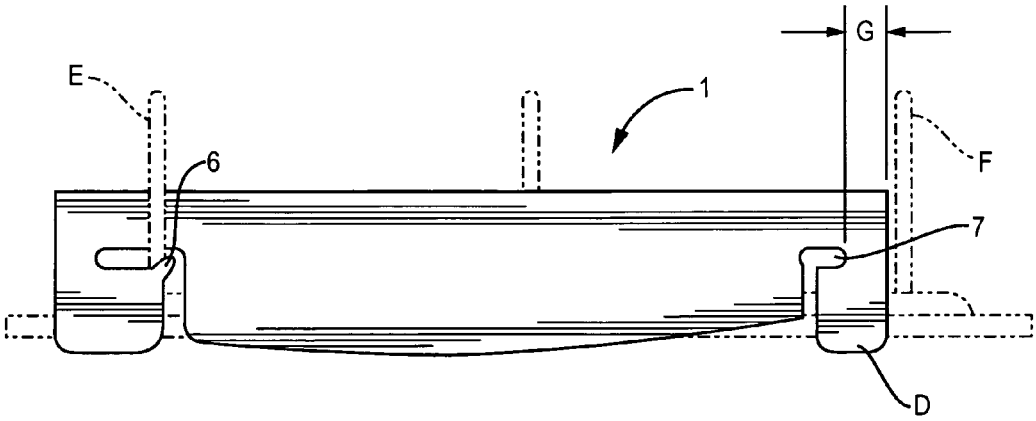
FIG. 3*c* shows the Sheet Lifter 1 with the end at the elongated notch 5 being engaged with the ring labeled E and the end at the short notch 7 not being engaged with the ring labeled F. The distance from the extreme end of the short notch 7 to the extreme right end of the Sheet Lifter 1, is labeled as G. The protruding knob 6 prevents the Sheet Lifter 1 from being removed from ring E without an intentional force. The dimensions of the Sheet Lifter are such that the Sheet Lifter 1, may move freely when the short notch 7 is not engaged with ring F. Once the D end of the Sheet Lifter 1 is released, the Sheet Lifter 1 may be swung outward for loading or unloading of sheets or pages. The protruding knob 6 insures that the Sheet Lifter 1 remains attached to ring E.

FIG. 3*a* shows a side view of the Sheet Lifter 1 positioned on a three ring binder spine 2. The distance from the first ring is indicated as B. FIG. 3*b* shows the Sheet Lifter 1 with the distance from the extreme end of the elongated notch 5 to the extreme end of the short notch 7 being indicated as A The Further the short notch is labeled as D. The distance A is slightly longer than the distance B. FIG. 3*c* shows the Sheet Lifter 1 with the end at the elongated notch 5 being engaged with the ring labeled E and the end at the short notch 7 not being engaged with the ring labeled F. The distance from the extreme end of the short notch 7 to the extreme right end of the Sheet Lifter 1, is labeled as G. The protruding knob 6 prevents the Sheet Lifter 1 from being removed from ring E without an intentional force. The dimensions of the Sheet Lifter are such that the Sheet Lifter 1, may move freely when the short notch 7 is not engaged with ring F. Once the D end of the Sheet Lifter 1 is released, the Sheet Lifter 1 may be swung outward and laid flat for loading or unloading of sheets or pages. The knob 6 insures that the Sheet Lifter 1 remains attached to ring E. The Sheet Lifter 1 is able to be easily removed from a holder or binder without the need to open the rings. This is means that the sheets or pages remain on the rings. It is also possible to easily install the Sheet Lifter 1 in a holder or binder without opening the rings or removing the sheet or pages. There is no other conventional or existing sheet lifter that may be removed or installed without opening the rings of the holder or binder.

Figure 4:
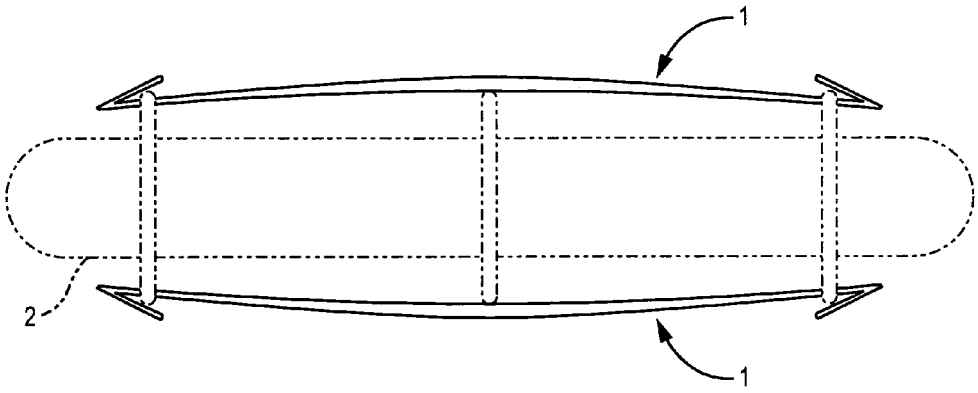
FIG. 4. is a top view showing two Sheet Lifters 1 engaged with the rings of a three ring binder that are attached to the binder's spine 2. The Sheet Lifters are positioned in order that the Sheet Lifters 1 are on the inner surface of the ring at the elongated notches 5. The Sheet Lifters 1 are positioned in order that the Sheet Lifters 1 are positioned on the outer surface of the middle ring. The Sheet Lifters 1 are positioned in order that the Sheet Lifters 1 are on the inner surface of the ring at the short notches 7.

FIG. 4. is a top view showing two Sheet Lifters 1 engaged with the rings of a three ring binder that are attached to the binder's spine 2. The Sheet Lifters are positioned in order that the Sheet Lifters 1 are on the inner surface of the ring at the elongated notches 5. The Sheet Lifters 1 are positioned in order that the Sheet Lifters 1 are positioned on the outer surface of the middle ring. The Sheet Lifters 1 are positioned in order that the Sheet Lifters 1 are on the inner surface of the ring at the short notches 7.

Figure 5:
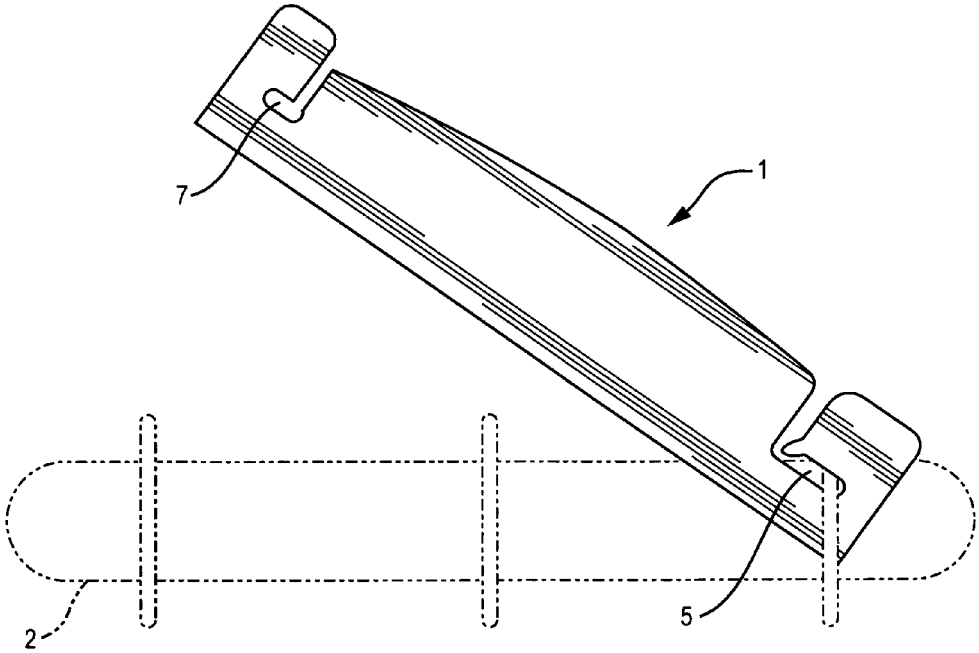
FIG. 5 illustrates the ability of the Sheet Lifter 1 to swing freely when released at the short notch 7 while still being engaged at the elongated notch 5. Also shown is the spine 2 of the ring binder.

FIG. 5 illustrates the ability of the Sheet Lifter 1 to swing freely when released at the short notch 7 while still being engaged at the elongated notch 5. As stated above this feature permits the Sheet Lifter 1 to be easily removed or installed in a holder or binder without the need to open the rings.

Figure 6:
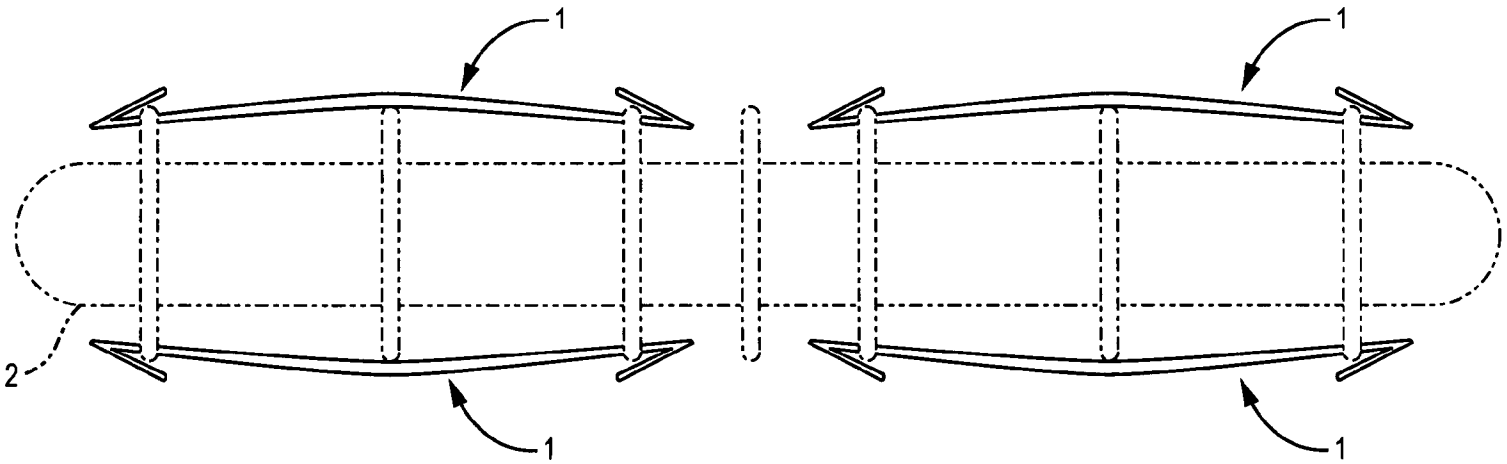
FIG. 6 illustrates a top view of how the Sheet Lifters 1 would engage with a multi ring binder such as a seven ring binder. Also shown is the spine 2 of the ring binder.

FIG. 6 illustrates a top view of how the Sheet Lifters 1 would engage with a multi ring binder such as a seven ring binder.

Figure 7:
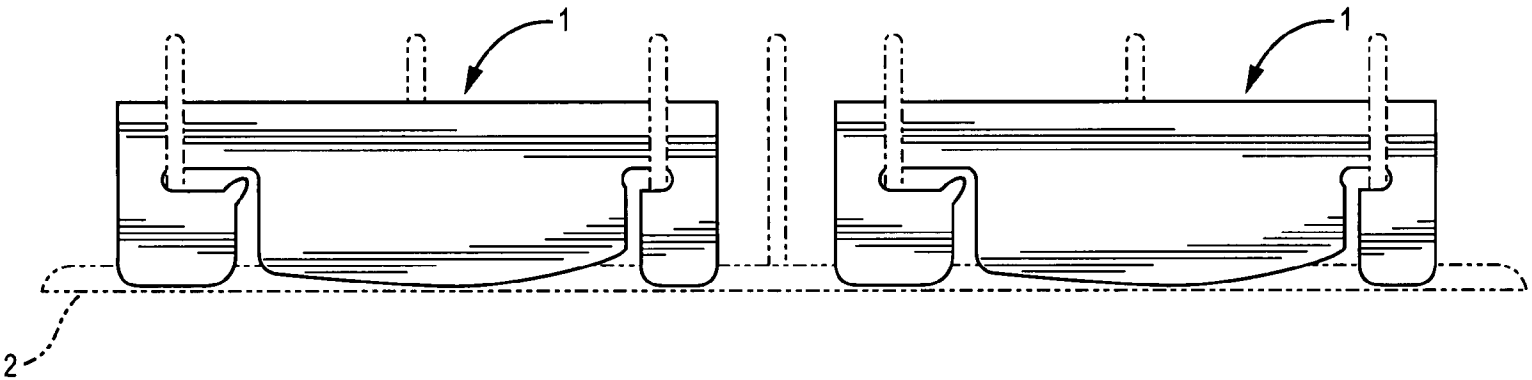
FIG. 7 illustrates a side view of how the Sheet Litters 1 would engage with a multi ring binder such as a seven ring binder. Also shown is the spine 2 of the ring binder.

FIG. 7 illustrates a side view of how the Sheet Lifters 1 would engage with a multi ring binder such as a seven ring binder.

Figure 9:
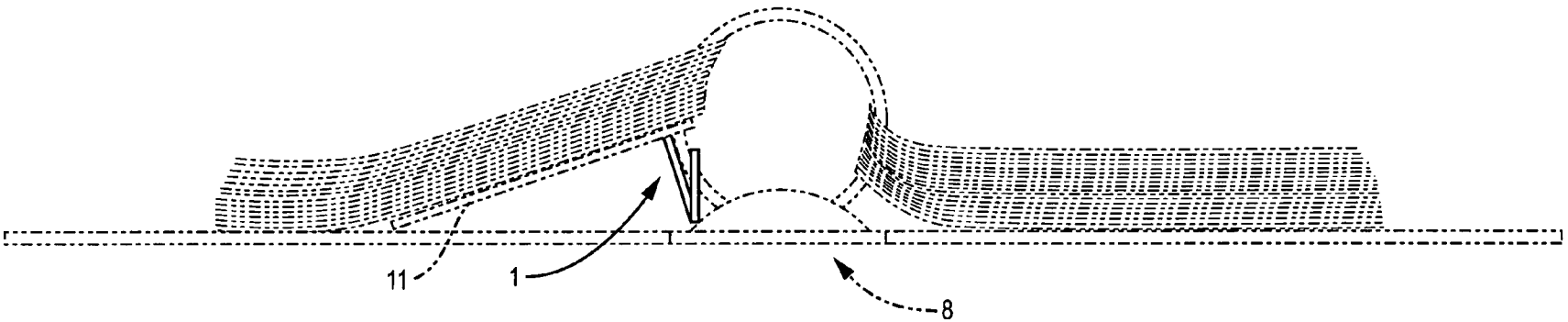
FIG. 9 is an end view of a ring binder 8 in a fully opened position. The sheets in the binder are shown in a flat position on the right side where there is no Sheet Binder. The sheets on the left are shown raised and resting on the Sheet Lifter 1. Also shown on the left side is a conventional lifter 11. The sheets on the left are able to be fully viewed and turned. The Sheet Lifter 1 does not interfere with the ability to view or turn the desired page or pages.
Figure 10:
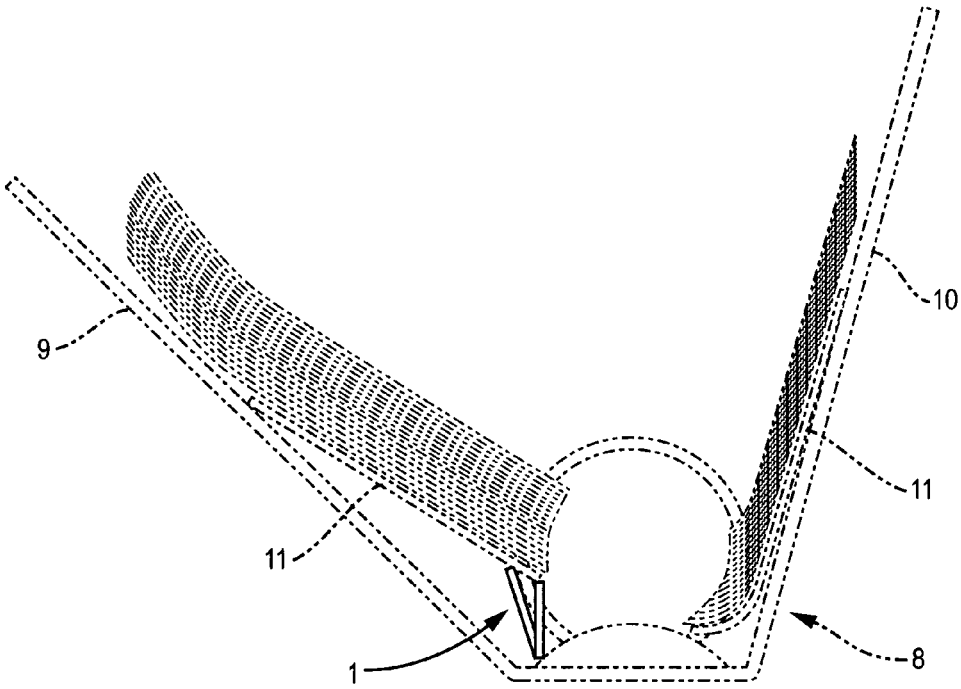
FIG. 10 is an end view of a ring binder 8 with the left cover 9 in a partially closed position. There is a Sheet Lifter 1 indicated on the left side together with a conventional sheet lifter 11. As can be seen the Sheet Lifter 1 raises both the conventional sheet lifter 11 and the sheets in order that there is no binding. There is also shown a right cover 10. There is no Sheet Lifter 1 on the right side. However, on the right side there is a conventional sheet lifter 11 which is shown binding, as are the sheets, as the right cover 10 is closed.

When the traditional multi ring sheet or page holder and multi ring binder is not being used the holder or binder is in a closed configuration. When the holder or binder is being used, the holder or binder is usually in an open configuration. FIG. 9 is an end view of a ring binder 8 in a fully opened position. The sheets in the binder are shown in a flat position on the right side where there is no Sheet Lifter. The sheets on the left are shown together with a conventional sheet lifter 11 raised and resting on the Sheet Lifter 1. The sheets on the left are able to be fully viewed and turned. The sheets on the right will bind when the user attempts to move more than a few sheets to turn them for viewing. The conventional sheet lifter 11, without the Sheet Lifter 1 in place, would rest in a flat position. FIG. 10 shows an end view of a ring binder with sheets, a conventional sheet lifter 11 and Sheet Lifter 1 on the left side and only sheets and a conventional sheet lifter 11 on the right side. As FIG. 10 demonstrates when the right cover is moved to close the holder or binder the conventional sheet lifter 11 will bind on the rings unless the user takes an extra step and moves the conventional sheet lifter 11 and sheets up and around the horizontal diameter extreme of the rings. The left cover can be easily closed without binding as shown in FIG. 10. The Sheet Lifter 1 does not interfere with the ability to view or turn the desired page or pages.

When the holder or binder is in the open position, the sheets or pages are able to be moved. In the open position the sheets or pages rest on either the inside of the front cover 9, back cover 10 or both. When the sheets or pages are in this open configuration they slide around the rings from the highest diameter extreme of the rings 12 past the horizontal diameter extreme of the rings 13 almost to the bottom diameter extreme of the rings 14. The sheets on the right side of FIG. 9 illustrate this situation. When the holder or binder is in the closed configuration the intent is for the sheets or pages to be returned to the highest diameter extreme of the rings. The problem is when the holder or binder is returned to the closed configuration the front and back covers cause an inward pressure on the sheets or pages when in reality the sheets or pages require an outward and upward pressure to further move upward and around the horizontal diameter extreme of the rings allowing the natural motion of the closing cover to move the pages to the highest diameter extreme of the rings. The conventional sheet lifter does not overcome this problem.

The proper positioning of the sheets/pages or Sheet Lifter is dependent on the motion of the closing cover to work. The motion of a closing cover is inward and upward in an arc.

Figure 8:
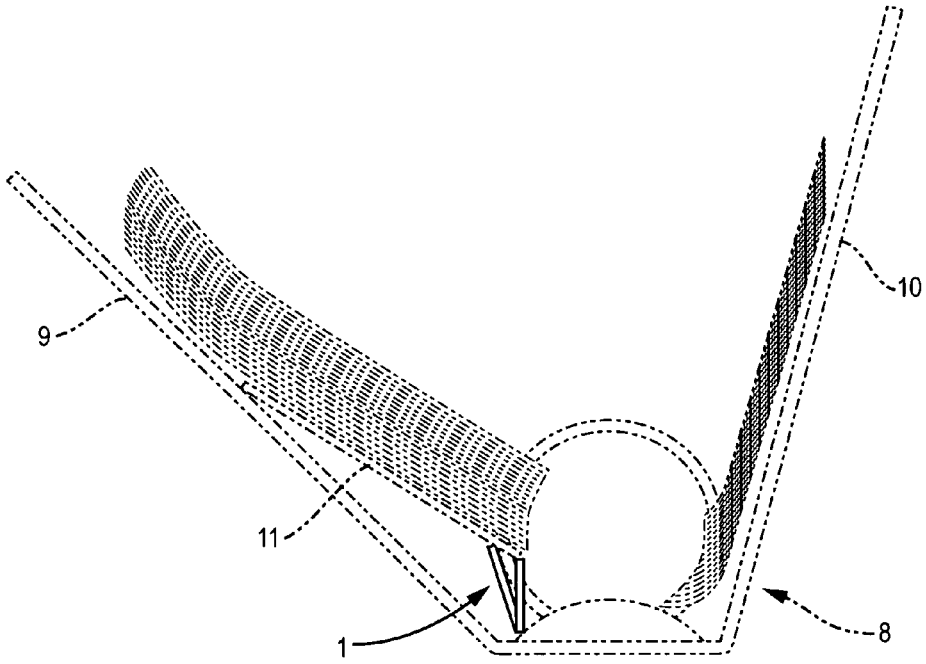
FIG. 8 illustrates how the Sheet Lifter 1 works. The view is an end view of a ring binder 8 in a partially closed position. The sheets on the left side are raised by the Sheet Lifter 1 and will travel further up and around the rings as the left cover 9 is closed further. The sheets on the right side have bound up as the right cover 10 has started to close and will not move, rather the sheets may be damaged as the right cover 10 closes further.

In the act of closing, as illustrated in FIG. 8, the right cover 10 creates inward pressure on the pages/sheets causing them to first move inward toward the center of the ring mechanism. Unfortunately, the necessary motion for proper page movement is out and up. Once positioned inward, there is no motion that can be made by the simple closing of the cover to then cause outward and upward motion to the pages/sheets which would cause them to move outward and then upward and around the ring mechanism's circumference. This results in the pages/sheets being jammed into the lower part of the ring mechanism's diameter and then possibly wedged between the rings and the inside of the cover. FIG. 10 demonstrates that even with a conventional sheet lifter 11 on the right the pages, together with the conventional sheet lifter 11, jam when the right cover is closed. This is why conventional sheet lifter devices do not work.

The present invention solves this problem. As shown in FIG. 8 the Sheet Lifter 1 on the left cover 9 positions the sheets so that they may be moved properly by the simple closing of the holder left cover 9. The invention holds the sheet/pages high enough on the binder rings to keep them from falling below the approximate half way part, or horizontal extreme of the diameter of the ring. By doing so, the invention allows the cover of the loose-leaf binder in conjunction with the Sheet Lifter 1 to apply the correct leverage and pressure to the sheet/pages to cause the sheet/pages to move, or slide, upward and toward the top, or highest extreme, and away from the side, or horizontal extreme, of the ring mechanism as the front and back covers are closed.

FIG. 8 illustrates how the Sheet Lifter 1 works. The view is an end view of a ring binder 8 in a partially closed-position. The sheets on the left side are raised by the Sheet Lifter 1 and will travel farther up and around the rings as the left cover 9 is closed further. A conventional sheet lifter 11 is also shown. The Sheet Lifter 1 is able to work even with the conventional sheet lifter 11 in place in fact the conventional sheet lifter 11 will not work easily and properly without the Sheet Lifter 1 as shown in FIG. 10. The sheets on the right side have bound up as the right cover 10 has started to close and will not move, rather the sheets may be damaged as the right cover 10 closes further. FIGS. 8, 9 and 10 show a conventional sheet lifter 11 resting on the top edge of the Sheet Lifter 1 on the left side. As can be seen the conventional sheet lifter will travel with the sheets. Without the Sheet Lifter 1 the conventional sheet lifter 11 would bind up on the rings as the sheets on the right are shown doing in FIG. 10.

From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim the following:

1. New and improved Sheet Lifter for use with a three ring binder containing a plurality of pages or sheets where the three ring binder has a first ring, a second ring and a third ring, the rings having a predetermined distance from the first ring to the third ring, further the rings having a predetermined diameter, an inner surface and an outer surface, and further said three ring binder having a spine, comprising:

a.) a flat panel, said flat panel being made of rigid material from the group of materials that have a position memory, said flat panel having an inner surface and an outer surface, further the flat panel having a first end, a middle section and a second end, further said flat panel having a length dimension, a width dimension and a thickness dimension, the flat panel length dimension being longer than the distance from the first ring to the third ring of the three ring binder, the width dimension being approximately equal to one half the diameter of the rings of the three ring binder, further the flat panel having a top edge that is straight and a bottom edge that has a convex curvature, said flat panel having an elongated notch at the bottom edge near the first end and a short notch at the bottom edge at the second end, both notches being L shaped, with the elongated notch having a knob, the flat panel remains rigid and supports the pages or sheets when two of the flat panels are positioned in opposition with the bottom edge convex curvature resting on the three ring binder spine with the flat panel's first end extending through the first ring being engaged with said first ring at the elongated notch with the flat panel's outer surface resting against the inner surface of said first ring, further with the flat panel's middle section's inner surface resting against the second ring outer surface and further with the flat panel's second end extending through the third ring being engaged with said third ring at the short notch with the flat panel's outer surface resting against the inner surface of said third ring.

2. New and improved Sheet Lifter for use with a multi ring binder containing a plurality of pages or sheets where the multi ring binder has a first ring, a second ring and a third ring, and at least a fifth ring, a sixth ring and a seventh ring the rings having a predetermined distance from the first ring to the third ring, said distance being the same as the distance from the fifth ring to the seventh ring, further the rings having a predetermined diameter, an inner surface and an outer surface, and further said multi ring binder having a spine, comprising:

a.) a plurality of flat panels, said flat panels being made of rigid material from the group of materials that have a position memory, said flat panels having a first end, a middle section and a second end, further said flat panels having an inner surface and an outer surface, further the flat panel having a length dimension, a width dimension and a thickness dimension, the flat panels length dimension being longer than the distance from the first ring to the third ring of the multi ring binder, the width dimension being approximately equal to one half the diameter of the rings of the multi ring binder, further the flat panels have a top edge that is straight and a bottom edge that has a convex curvature, said flat panels have an elongated notch at the bottom edge near the first end and a short notch at the bottom edge at the second end, both notches being L shaped, with the elongated notch having a knob, the flat panels remain rigid and support the pages or sheets when two of the flat panels are positioned with the bottom edge convex curvature resting on the multi ring binder spine with the flat panel's first end extending through the first ring being engaged with said first ring at the elongated notch with the flat panel outer surface resting against the inner surface of said first ring, further with the flat panel's middle section's inner surface resting against the second ring outer surface and further with the flat panel's second end extending through the third ring being engaged with said third ring at the short notch with the flat panel's outer surface resting against the inner surface of said third ring and two of the flat panels are positioned with the bottom edge convex curvature resting on the multi ring binder spine with the flat panel's first end extending through the fifth ring being engaged with said fifth ring at the elongated notch with the flat panel's outer surface resting against the inner surface of said fifth ring, further with the flat middle section's inner surface resting against the sixth ring outer surface and further with the flat panel's second end extending through the seventh ring being engaged with said seventh ring at the short notch with the flat panel's outer surface resting against the inner surface of said seventh ring.

3. A new and improved Sheet Lifter as described in claim 1 and further comprising:

a. where the flat panel width dimension is equal to one half the diameter of the rings of the three ring binder.

4. A new and improved Sheet Lifter as described in claim 2 and further comprising:

a. where the flat panel width dimension is equal to one half the diameter of the rings of the multi ring binder.

5. A new and improved Sheet Lifter as described in claim 3 and further comprising:

a. where the three ring binder already contains conventional sheet lifters and the conventional sheet lifters rest on the top edge of the flat panels with the plurality of pages or sheets resting on top of the conventional sheet lifters.

6. A new and improved Sheet Lifter as described in claim 4 and further comprising:

a. where the multi ring binder already contains conventional sheet lifters and the conventional sheet lifters rest on the top edge of the flat panels with the plurality of pages or sheets resting on top of the conventional sheet lifters.

* * * * *